US011212902B2

(12) United States Patent
De Antonis et al.

(10) Patent No.: US 11,212,902 B2
(45) Date of Patent: Dec. 28, 2021

(54) MULTIPLEXED DRIVE SYSTEMS AND METHODS FOR A MULTI-EMITTER X-RAY SOURCE

(71) Applicant: Rapiscan Systems, Inc., Torrance, CA (US)

(72) Inventors: Paul De Antonis, Horsham (GB); Edward James Morton, Guildford (GB); Russell David Luggar, Dorking (GB)

(73) Assignee: Rapiscan Systems, Inc., Torrance, CA (US)

( * ) Notice: Subject to any disclaimer, the term of this patent is extended or adjusted under 35 U.S.C. 154(b) by 0 days.

(21) Appl. No.: 16/800,908

(22) Filed: Feb. 25, 2020

(65) Prior Publication Data

US 2021/0265126 A1 Aug. 26, 2021

(51) Int. Cl.

| | |
|---|---|
| ***H05G 1/56*** | (2006.01) |
| *H01J 35/06* | (2006.01) |
| *H01J 35/04* | (2006.01) |
| *H01J 35/14* | (2006.01) |
| *H05G 1/70* | (2006.01) |

(Continued)

(52) U.S. Cl.

CPC ..... *H05G 1/56* (2013.01); *H01J 35/045* (2013.01); *H01J 35/064* (2019.05); *H01J 35/14* (2013.01); *H01J 2235/023* (2013.01); *H05G 1/085* (2013.01); *H05G 1/30* (2013.01); *H05G 1/52* (2013.01); *H05G 1/70* (2013.01)

(58) Field of Classification Search

CPC ..... H05G 1/56; H05G 1/085; H05G 1/30; H05G 1/70; H05G 1/52; H01J 2235/02; H01J 2235/023; H01J 35/064; H01J 35/14; H01J 35/045

See application file for complete search history.

(56) References Cited

U.S. PATENT DOCUMENTS

| | | | |
|---|---|---|---|
| 2,636,619 | A | 4/1953 | Alexander |
| 3,239,706 | A | 3/1966 | Farrell |

(Continued)

FOREIGN PATENT DOCUMENTS

| | | | |
|---|---|---|---|
| DE | 3840398 | A1 | 6/1989 |
| DE | 4410757 | A1 | 1/1995 |

(Continued)

OTHER PUBLICATIONS

Circuits Today, "Digital Logic Gates", (Jan. 8, 2018), Retrieved from the internet: <<https://web.archive.org/web/20180108012931/https://www.circuitstoday.com/logic-gates>>. (Year: 2018).*

(Continued)

*Primary Examiner* — Chih-Cheng Kao
(74) *Attorney, Agent, or Firm* — Novel IP

(57) ABSTRACT

An improved X-ray source is disclosed. The improved X-ray source has an enclosure, electron guns, a first set of address lines extending through the enclosure, a second set of address lines extending through the enclosure, and nodes defined by the intersection of the first and second set of address lines. Each of the electron guns is coupled to one of the nodes such that a state of each electron gun is uniquely controlled by modulating a state of one of the first set of address lines and one of the second set of address lines.

40 Claims, 8 Drawing Sheets

(51) Int. Cl.

| | |
|---|---|
| *H05G 1/52* | (2006.01) |
| *H05G 1/30* | (2006.01) |
| *H05G 1/08* | (2006.01) |

(56) References Cited

U.S. PATENT DOCUMENTS

| | | | |
|---|---|---|---|
| 3,275,831 | A | 9/1966 | Martin |
| 3,374,355 | A | 3/1968 | Parratt |
| 3,439,166 | A | 4/1969 | Chope |
| 3,837,502 | A | 9/1974 | Hornagold |
| 3,904,923 | A | 9/1975 | Schwartz |
| 4,057,725 | A | 11/1977 | Wagner |
| 4,164,138 | A | 8/1979 | Burkhart |
| 4,171,254 | A | 10/1979 | Koenecke |
| 4,228,353 | A | 10/1980 | Johnson |
| 4,239,969 | A | 12/1980 | Galetta |
| 4,274,005 | A | 6/1981 | Yamamura |
| 4,420,382 | A | 12/1983 | Riedl |
| 4,531,226 | A | 7/1985 | Peschmann |
| 4,658,408 | A | 4/1987 | Amor |
| 4,672,649 | A | 6/1987 | Rutt |
| 4,675,890 | A | 6/1987 | Plessis |
| 4,719,645 | A | 1/1988 | Yamabe |
| 4,868,856 | A | 9/1989 | Frith |
| 4,887,604 | A | 12/1989 | Shefer |
| 5,014,293 | A | 5/1991 | Boyd |
| 5,041,728 | A | 8/1991 | Spacher |
| 5,056,124 | A | 10/1991 | Kakimoto |
| 5,065,418 | A | 11/1991 | Bermbach |
| 5,159,234 | A | 10/1992 | Wegmann |
| 5,181,234 | A | 1/1993 | Smith |
| 5,185,778 | A | 2/1993 | Magram |
| 5,197,088 | A | 3/1993 | Vincent |
| 5,202,932 | A | 4/1993 | Cambier |
| 5,247,556 | A | 9/1993 | Eckert |
| 5,259,012 | A | 11/1993 | Baker |
| 5,329,180 | A | 7/1994 | Popli |
| 5,363,940 | A | 11/1994 | Fahrion |
| 5,467,377 | A | 11/1995 | Dawson |
| 5,493,596 | A | 2/1996 | Annis |
| 5,503,424 | A | 4/1996 | Agopian |
| 5,600,303 | A | 2/1997 | Husseiny |
| 5,606,167 | A | 2/1997 | Miller |
| 5,633,907 | A | 5/1997 | Gravelle |
| 5,651,047 | A | 7/1997 | Moorman |
| 5,692,028 | A | 11/1997 | Geus |
| 5,692,029 | A | 11/1997 | Husseiny |
| 5,796,802 | A | 8/1998 | Gordon |
| 5,798,972 | A | 8/1998 | Lao |
| 5,838,758 | A | 11/1998 | Krug |
| 5,841,831 | A | 11/1998 | Hell |
| 5,842,578 | A | 12/1998 | Cordeiro |
| 5,879,807 | A | 3/1999 | Inoue |
| 5,909,478 | A | 6/1999 | Polichar |
| 5,943,388 | A | 8/1999 | Tuemer |
| 5,974,111 | A | 10/1999 | Krug |
| 6,056,671 | A | 5/2000 | Marmer |
| 6,081,580 | A | 6/2000 | Grodzins |
| 6,088,423 | A | 7/2000 | Krug |
| 6,216,540 | B1 | 4/2001 | Nelson |
| 6,220,099 | B1 | 4/2001 | Marti |
| 6,240,157 | B1 | 5/2001 | Danielsson |
| 6,249,567 | B1 | 6/2001 | Rothschild |
| 6,292,533 | B1 | 9/2001 | Swift |
| 6,301,327 | B1 | 10/2001 | Martens |
| 6,324,243 | B1 | 11/2001 | Edic |
| 6,347,132 | B1 | 2/2002 | Annis |
| 6,417,797 | B1 | 7/2002 | Cousins |
| 6,418,194 | B1 | 7/2002 | McPherson |
| 6,459,761 | B1 | 10/2002 | Grodzins |
| 6,459,764 | B1 | 10/2002 | Chalmers |
| 6,542,574 | B2 | 4/2003 | Grodzins |
| 6,542,580 | B1 | 4/2003 | Carver |
| 6,552,346 | B2 | 4/2003 | Verbinski |
| 6,614,872 | B2 | 9/2003 | Bueno |
| 6,665,373 | B1 | 12/2003 | Kotowski |
| 6,674,838 | B1 | 1/2004 | Barrett |
| 6,702,459 | B2 | 3/2004 | Barnes |
| 6,713,773 | B1 | 3/2004 | Lyons |
| 6,801,002 | B2 | 10/2004 | Victor |
| 6,843,599 | B2 | 1/2005 | Le |
| 6,920,197 | B2 | 7/2005 | Kang |
| 6,924,487 | B2 | 8/2005 | Bolozdynya |
| 6,928,141 | B2 | 8/2005 | Carver |
| 7,046,768 | B1 | 5/2006 | Gilevich |
| 7,135,814 | B2 | 11/2006 | Jung |
| 7,151,447 | B1 | 12/2006 | Willms |
| 7,203,276 | B2 | 4/2007 | Arsenault |
| 7,207,713 | B2 | 4/2007 | Lowman |
| 7,215,738 | B2 | 5/2007 | Muenchau |
| 7,224,763 | B2 | 5/2007 | Naidu |
| 7,322,745 | B2 | 1/2008 | Agrawal |
| 7,366,282 | B2 | 4/2008 | Peschmann |
| 7,369,643 | B2 | 5/2008 | Kotowski |
| 7,372,934 | B2 | 5/2008 | De |
| 7,379,530 | B2 | 5/2008 | Hoff |
| 7,397,891 | B2 | 7/2008 | Johnson |
| 7,400,701 | B1 | 7/2008 | Cason |
| 7,417,440 | B2 | 8/2008 | Peschmann |
| 7,418,077 | B2 | 8/2008 | Gray |
| 7,453,987 | B1 | 11/2008 | Richardson |
| 7,471,764 | B2 | 12/2008 | Kaval |
| 7,483,510 | B2 | 1/2009 | Carver |
| 7,486,768 | B2 | 2/2009 | Allman |
| 7,517,149 | B2 | 4/2009 | Agrawal |
| 7,519,148 | B2 | 4/2009 | Kotowski |
| 7,525,101 | B2 | 4/2009 | Grodzins |
| 7,526,064 | B2 | 4/2009 | Akery |
| 7,579,845 | B2 | 8/2009 | Peschmann |
| 7,636,638 | B2 | 12/2009 | Russ |
| 7,660,388 | B2 | 2/2010 | Gray |
| 7,684,538 | B2 | 3/2010 | Morton |
| 7,720,195 | B2 | 5/2010 | Allman |
| 7,724,868 | B2 | 5/2010 | Morton |
| 7,728,397 | B2 | 6/2010 | Gorrell |
| 7,742,568 | B2 | 6/2010 | Smith |
| 7,769,133 | B2 | 8/2010 | Carver |
| 7,783,004 | B2 | 8/2010 | Kotowski |
| 7,783,005 | B2 | 8/2010 | Kaval |
| 7,817,776 | B2 | 10/2010 | Agrawal |
| 7,835,495 | B2 | 11/2010 | Harding |
| 7,856,081 | B2 | 12/2010 | Peschmann |
| 7,860,213 | B2 | 12/2010 | Akery |
| 7,876,879 | B2 | 1/2011 | Morton |
| 7,876,880 | B2 | 1/2011 | Kotowski |
| 7,903,789 | B2 | 3/2011 | Morton |
| 7,915,596 | B2 | 3/2011 | Clothier |
| 7,928,400 | B1 | 4/2011 | Diawara |
| 7,929,663 | B2 | 4/2011 | Morton |
| 7,949,101 | B2 | 5/2011 | Morton |
| 7,963,695 | B2 | 6/2011 | Kotowski |
| 7,982,191 | B2 | 7/2011 | Friedman |
| 7,991,113 | B2 | 8/2011 | Carver |
| 7,991,133 | B2 | 8/2011 | Mills |
| 7,995,705 | B2 | 8/2011 | Allman |
| 8,054,938 | B2 | 11/2011 | Kaval |
| 8,059,781 | B2 | 11/2011 | Agrawal |
| 8,073,099 | B2 | 12/2011 | Niu |
| 8,085,897 | B2 | 12/2011 | Morton |
| 8,094,784 | B2 | 1/2012 | Morton |
| 8,135,110 | B2 | 3/2012 | Morton |
| 8,138,770 | B2 | 3/2012 | Peschmann |
| 8,170,177 | B2 | 5/2012 | Akery |
| 8,204,173 | B2 | 6/2012 | Betcke |
| 8,223,919 | B2 | 7/2012 | Morton |
| 8,243,876 | B2 | 8/2012 | Morton |
| 8,275,091 | B2 | 9/2012 | Morton |
| 8,331,535 | B2 | 12/2012 | Morton |
| 8,356,937 | B2 | 1/2013 | Kotowski |
| 8,385,501 | B2 | 2/2013 | Allman |
| 8,389,942 | B2 | 3/2013 | Morton |
| 8,428,217 | B2 | 4/2013 | Peschmann |
| 8,433,036 | B2 | 4/2013 | Morton |
| 8,451,974 | B2 | 5/2013 | Morton |

(56) References Cited

U.S. PATENT DOCUMENTS 8,457,275 B2 6/2013 Akery
8,483,356 B2 7/2013 Bendahan
8,491,189 B2 7/2013 Kotowski
8,503,605 B2 8/2013 Morton
8,552,722 B2 10/2013 Morton
8,559,592 B2 10/2013 Betcke
8,579,506 B2 11/2013 Morton
8,625,735 B2 1/2014 Morton
8,644,453 B2 2/2014 Morton
8,668,386 B2 3/2014 Morton
8,674,706 B2 3/2014 Peschmann
8,687,765 B2 4/2014 Kotowski
8,735,833 B2 5/2014 Morto
8,750,452 B2 6/2014 Kaval
8,774,357 B2 7/2014 Morton
8,798,232 B2 8/2014 Bendahan
8,804,899 B2 8/2014 Morton
8,824,637 B2 9/2014 Morton
8,831,176 B2 9/2014 Morto
8,837,669 B2 9/2014 Morton
8,837,670 B2 9/2014 Akery
8,840,303 B2 9/2014 Morton
8,885,794 B2 11/2014 Morton
8,908,831 B2 12/2014 Bendahan
8,929,509 B2 1/2015 Morton
8,958,526 B2 2/2015 Morton
8,971,485 B2 3/2015 Morton
8,993,970 B2 3/2015 Morton
9,001,973 B2 4/2015 Morton
9,020,095 B2 4/2015 Morton
9,020,096 B2 4/2015 Allman
9,025,731 B2 5/2015 Kotowski
9,036,779 B2 5/2015 Morton
9,042,511 B2 5/2015 Peschmann
9,046,465 B2 6/2015 Thompson
9,048,061 B2 6/2015 Morton
9,052,403 B2 6/2015 Morton
9,057,679 B2 6/2015 Morton
9,086,497 B2 7/2015 Bendahan
9,093,245 B2 7/2015 Morton
9,111,331 B2 8/2015 Parikh
9,113,839 B2 8/2015 Morton
9,121,958 B2 9/2015 Morton
9,158,027 B2 10/2015 Morton
9,158,030 B2 10/2015 Morton
9,183,647 B2 11/2015 Morton
9,208,988 B2 12/2015 Morton
9,218,933 B2 12/2015 Langeveld
9,223,049 B2 12/2015 Kotowski
9,223,050 B2 12/2015 Kaval
9,223,052 B2 12/2015 Morton
9,263,225 B2 2/2016 Morton
9,268,058 B2 2/2016 Peschmann
9,274,065 B2 3/2016 Morton
9,279,901 B2 3/2016 Akery
9,285,498 B2 3/2016 Carver
9,310,322 B2 4/2016 Panesar
9,310,323 B2 4/2016 Bendahan
9,316,760 B2 4/2016 Bendahan
9,329,285 B2 5/2016 Gozani
9,332,624 B2 5/2016 Morton
9,420,677 B2 8/2016 Morton
9,442,082 B2 9/2016 Morton
9,541,510 B2 1/2017 Arodzero
9,562,866 B2 2/2017 Morton
9,576,766 B2 2/2017 Morton
9,606,259 B2 3/2017 Morton
9,618,648 B2 4/2017 Morton
9,638,646 B2 5/2017 Morton
9,675,306 B2 6/2017 Morton
9,688,517 B2 6/2017 Morton
9,714,920 B2 7/2017 Morton
9,726,619 B2 8/2017 Thompson
9,747,705 B2 8/2017 Morton
9,817,151 B2 11/2017 Morton
9,958,569 B2 5/2018 Morton
10,007,019 B2 6/2018 Morton
10,107,783 B2 10/2018 Morton
10,175,381 B2 1/2019 Morton
10,228,487 B2 3/2019 Mastronardi
10,295,483 B2 5/2019 Morton
10,302,807 B2 5/2019 Yu
10,317,566 B2 6/2019 Morton
10,408,967 B2 9/2019 Morton
10,483,077 B2 11/2019 Morton
10,585,207 B2 3/2020 Morton
10,591,424 B2 3/2020 Morton
10,663,616 B2 5/2020 Morton
10,901,112 B2 1/2021 Morton
10,976,271 B2 4/2021 Morton
2001/0022830 A1 9/2001 Sommer
2001/0050972 A1 12/2001 Yamada
2002/0075545 A1 6/2002 Harrison
2002/0094064 A1 7/2002 Zhou
2002/0109844 A1 8/2002 Christel
2003/0043964 A1 3/2003 Sorenson
2003/0068557 A1 4/2003 Kumashiro
2003/0091148 A1 5/2003 Bittner
2003/0103212 A1 6/2003 Westphal
2003/0231739 A1 12/2003 Jeffrey
2004/0012494 A1 1/2004 Lee
2004/0017224 A1 1/2004 Tumer
2004/0022292 A1 2/2004 Morton
2004/0051265 A1 3/2004 Nadeau
2004/0066879 A1 4/2004 Yoshio
2004/0080315 A1 4/2004 Beevor
2004/0096030 A1 5/2004 Banchieri
2004/0120454 A1 6/2004 Ellenbogen
2004/0141584 A1 7/2004 Bernardi
2004/0252024 A1 12/2004 Huey
2004/0258198 A1 12/2004 Carver
2005/0023479 A1 2/2005 Grodzins
2005/0024199 A1 2/2005 Huey
2005/0031075 A1 2/2005 Hopkins
2005/0089140 A1 4/2005 Mario
2005/0100135 A1 5/2005 Lowman
2005/0111610 A1 5/2005 Deman
2005/0111619 A1 5/2005 Bijjani
2005/0117683 A1 6/2005 Mishin
2005/0123092 A1 6/2005 Mistretta
2005/0135668 A1 6/2005 Polichar
2005/0157842 A1 7/2005 Agrawal
2005/0169421 A1 8/2005 Muenchau
2005/0175151 A1 8/2005 Dunham
2005/0198226 A1 9/2005 Delia
2005/0276377 A1 12/2005 Carol
2005/0276382 A1 12/2005 Lesiak
2006/0008047 A1 1/2006 Zhou
2006/0027751 A1 2/2006 Kurita
2006/0050842 A1 3/2006 Wang
2006/0056584 A1 3/2006 Allman
2006/0114477 A1 6/2006 Cox
2006/0140341 A1 6/2006 Carver
2006/0182221 A1 8/2006 Bernhardt
2006/0249685 A1 11/2006 Tanaka
2006/0257005 A1 11/2006 Bergeron
2006/0273237 A1 12/2006 Thompson
2006/0284094 A1 12/2006 Inbar
2007/0025512 A1 2/2007 Gertsenshteyn
2007/0085010 A1 4/2007 Letant
2007/0122003 A1 5/2007 Dobkin
2007/0140423 A1 6/2007 Foland
2007/0172129 A1 7/2007 Tortora
2007/0183575 A1 8/2007 Lemaitre
2007/0189454 A1 8/2007 Georgeson
2007/0189597 A1 8/2007 Limer
2007/0210255 A1 9/2007 Bjorkholm
2007/0228284 A1 10/2007 Polichar
2007/0237293 A1 10/2007 Singh
2007/0242802 A1 10/2007 Dafni
2007/0280502 A1 12/2007 Paresi
2008/0019483 A1 1/2008 Andrews
2008/0037707 A1 2/2008 Rothschild
2008/0043912 A1 2/2008 Harding

(56) References Cited

U.S. PATENT DOCUMENTS

| | | | | |
|---|---|---|---|---|
| 2008/0048872 | A1 | 2/2008 | Frank | |
| 2008/0056436 | A1 | 3/2008 | Pack | |
| 2008/0084963 | A1 | 4/2008 | Clayton | |
| 2008/0123803 | A1 | 5/2008 | De Man | |
| 2008/0128624 | A1 | 6/2008 | Cooke | |
| 2008/0130974 | A1 | 6/2008 | Xu | |
| 2008/0159591 | A1 | 7/2008 | Ruedin | |
| 2008/0170670 | A1 | 7/2008 | Bhatt | |
| 2008/0198970 | A1 | 8/2008 | Kirshner | |
| 2008/0205594 | A1 | 8/2008 | Bjorkholm | |
| 2008/0230709 | A1 | 9/2008 | Tkaczyk | |
| 2008/0237480 | A1 | 10/2008 | Robinson | |
| 2008/0260097 | A1 | 10/2008 | Anwar | |
| 2008/0304622 | A1 | 12/2008 | Morton | |
| 2009/0003514 | A1 | 1/2009 | Edic | |
| 2009/0022264 | A1 | 1/2009 | Zhou | |
| 2009/0034792 | A1 | 2/2009 | Kennison | |
| 2009/0067575 | A1 | 3/2009 | Seppi | |
| 2009/0086907 | A1 | 4/2009 | Smith | |
| 2009/0116617 | A1 | 5/2009 | Mastronardi | |
| 2009/0127459 | A1 | 5/2009 | Neustadter | |
| 2009/0128557 | A1 | 5/2009 | Finlayson | |
| 2009/0159451 | A1 | 6/2009 | Tomantschger | |
| 2009/0168964 | A1 | 7/2009 | Safai | |
| 2009/0185660 | A1 | 7/2009 | Zou | |
| 2009/0238336 | A1 | 9/2009 | Akery | |
| 2009/0245462 | A1 | 10/2009 | Agrawal | |
| 2009/0257555 | A1 | 10/2009 | Chalmers | |
| 2009/0265386 | A1 | 10/2009 | March | |
| 2009/0285353 | A1 | 11/2009 | Ellenbogen | |
| 2009/0316851 | A1 | 12/2009 | Oosaka | |
| 2010/0020934 | A1 | 1/2010 | Morton | |
| 2010/0020937 | A1 | 1/2010 | Hautmann | |
| 2010/0025796 | A1 | 2/2010 | Dabiran | |
| 2010/0161504 | A1 | 6/2010 | Casey | |
| 2010/0177868 | A1 | 7/2010 | Smith | |
| 2010/0177873 | A1 | 7/2010 | Chen | |
| 2010/0219737 | A1* | 9/2010 | Werner | H01J 5/32 313/243 |
| 2010/0226479 | A1* | 9/2010 | Beyerlein | H01J 35/065 378/134 |
| 2010/0295689 | A1 | 11/2010 | Armistead | |
| 2010/0329532 | A1 | 12/2010 | Masuda | |
| 2011/0019797 | A1 | 1/2011 | Morton | |
| 2011/0019799 | A1 | 1/2011 | Shedlock | |
| 2011/0038453 | A1 | 2/2011 | Morton | |
| 2011/0064192 | A1 | 3/2011 | Morton | |
| 2011/0075808 | A1 | 3/2011 | Rothschild | |
| 2011/0188725 | A1 | 8/2011 | Yu | |
| 2011/0204243 | A1 | 8/2011 | Bendahan | |
| 2011/0235777 | A1 | 9/2011 | Gozani | |
| 2011/0266643 | A1 | 11/2011 | Engelmann | |
| 2012/0099710 | A1 | 4/2012 | Kotowski | |
| 2012/0104276 | A1 | 5/2012 | Miller | |
| 2012/0116720 | A1 | 5/2012 | Klann | |
| 2012/0219116 | A1 | 8/2012 | Thompson | |
| 2013/0001048 | A1 | 1/2013 | Panesar | |
| 2013/0264483 | A1 | 10/2013 | Abenaim | |
| 2014/0023181 | A1 | 1/2014 | Noshi | |
| 2014/0185771 | A1 | 7/2014 | Morton | |
| 2014/0197321 | A1 | 7/2014 | Bendahan | |
| 2014/0211916 | A1 | 7/2014 | Morton | |
| 2015/0036798 | A1 | 2/2015 | Morton | |
| 2015/0078519 | A1 | 3/2015 | Morton | |
| 2015/0301220 | A1 | 10/2015 | Morton | |
| 2015/0355117 | A1 | 12/2015 | Morton | |
| 2015/0355369 | A1 | 12/2015 | Morton | |
| 2015/0362440 | A1* | 12/2015 | Thompson | G01N 23/04 378/62 |
| 2016/0025889 | A1 | 1/2016 | Morton | |
| 2016/0033674 | A1 | 2/2016 | Allman | |
| 2016/0372309 | A1 | 12/2016 | Steiner | |
| 2018/0038988 | A1 | 2/2018 | Morton | |

FOREIGN PATENT DOCUMENTS

| | | | |
|---|---|---|---|
| DE | 4432205 | C1 | 1/1996 |
| DE | 4436688 | A1 | 4/1996 |
| DE | 19745998 | A1 | 3/1999 |
| DE | 19907758 | A1 | 8/1999 |
| DE | 10036210 | A1 | 11/2001 |
| DE | 10319549 | B3 | 12/2004 |
| EP | 0077018 | A1 | 4/1983 |
| EP | 0142249 | A2 | 5/1985 |
| EP | 00432568 | A | 6/1991 |
| EP | 0531993 | A | 3/1993 |
| EP | 0584871 | A | 3/1994 |
| EP | 0919186 | A2 | 6/1999 |
| EP | 0924742 | A | 6/1999 |
| EP | 0930046 | A | 7/1999 |
| EP | 1277439 | A | 1/2003 |
| EP | 1413898 | A1 | 4/2004 |
| FR | 2328280 | A | 5/1977 |
| GB | 1272498 | A | 4/1972 |
| GB | 2255634 | A | 11/1992 |
| GB | 2360405 | | 9/2001 |
| GB | 2409268 | A | 6/2005 |
| GB | 2423687 | A | 8/2006 |
| GB | 2424065 | A | 9/2006 |
| GB | 2438317 | A | 11/2007 |
| JP | H03198975 | A | 8/1991 |
| JP | H4079128 | A | 3/1992 |
| JP | H05135721 | A | 6/1993 |
| JP | H05182617 | A | 7/1993 |
| JP | H05290768 | A | 11/1993 |
| JP | H10211196 | A | 8/1998 |
| JP | 2001176408 | A | 6/2001 |
| JP | 2008166059 | A | 7/2008 |
| SU | 1022236 | A1 | 6/1983 |
| WO | 9701771 | A | 1/1997 |
| WO | 9718462 | A | 5/1997 |
| WO | 9855851 | A1 | 12/1998 |
| WO | 9960387 | A | 11/1999 |
| WO | 03048808 | A | 6/2003 |
| WO | 03051201 | A | 6/2003 |
| WO | 2004010127 | | 1/2004 |
| WO | 2004010127 | A1 | 1/2004 |
| WO | 2004097456 | A | 11/2004 |
| WO | 2004097888 | | 11/2004 |
| WO | 2004097889 | | 11/2004 |
| WO | 2004097889 | A2 | 11/2004 |
| WO | 2005050405 | | 6/2005 |
| WO | 2005098400 | A2 | 10/2005 |
| WO | 2006027122 | A1 | 3/2006 |
| WO | 2006036076 | A1 | 4/2006 |
| WO | 2006053279 | A2 | 5/2006 |
| WO | 2006078691 | A2 | 7/2006 |
| WO | 2006130630 | A2 | 12/2006 |
| WO | 2007035359 | A2 | 3/2007 |
| WO | 2007055720 | A2 | 5/2007 |
| WO | 2007068933 | A1 | 6/2007 |
| WO | 2007103216 | A2 | 9/2007 |
| WO | 2008017983 | A2 | 2/2008 |
| WO | 2008027703 | A2 | 3/2008 |
| WO | 2009012453 | A1 | 1/2009 |
| WO | 2009106803 | A2 | 9/2009 |
| WO | 2009143169 | A1 | 11/2009 |
| WO | 2010138607 | A1 | 12/2010 |
| WO | 2011069024 | A1 | 6/2011 |
| WO | 2011091070 | A2 | 7/2011 |
| WO | 2013116549 | | 8/2013 |
| WO | 2013119423 | A1 | 8/2013 |
| WO | 2014107675 | | 7/2014 |
| WO | 2014121097 | A1 | 8/2014 |
| WO | 2014124152 | A2 | 8/2014 |
| WO | 2016011205 | | 1/2016 |
| WO | 2020023603 | A1 | 1/2020 |

OTHER PUBLICATIONS

International Search Report for PCT/US20/19726, dated May 15, 2020.

(56) References Cited

OTHER PUBLICATIONS

Written Opinion of the International Searching Authority for PCT/US20/19726, dated May 15, 2020.
CRS Report for Congress, Aviation Security Technologies and Procedures: Screening Passengers and Baggage, Oct. 26, 2001, pp. 1-12.
International Search Report for PCT/US2015/040653, dated Dec. 16, 2015.
International Search Report for PCT/US14/56652, dated Apr. 27, 2015.
International Search Report for PCT/US14/14198, dated May 16, 2014.
International Preliminary Report on Patentability for PCT/US2014/014198, dated Aug. 4, 2015.
International Search Report for PCT/US11/21758; dated Jul. 7, 2011, Rapiscan Systems Inc.
International Preliminary Report on Patentability for PCT/US11/21758, dated Jul. 7, 2011.
Written Opinion on Patentability for PCT/US11/21758; dated Jul. 7, 2011; Rapiscan Systems.
Molchanov P A et al.: 'Nanosecond gated optical sensors for ocean optic applications' Sensors Applications Symposium, 2006. Proceedings of the 2006 IEEE Houston, Texas,USA Feb. 7-9, 2006, Piscataway, NJ, USA,IEEE, Feb. 7, 2006 (Feb. 2-7, 2006) , pp. 147-150, XP010917671 ISBN: 978-0-7803-9580-0.
Mobile X-Ray Inspection Systems, Internet Citation, Feb. 12, 2007, pp. 1-2, URL:http://web.archive.org/web/20070212000928/http://www.bombdetecti- on.com/cat-details.php?catid=20.
International Search Report for PCT/GB09/00575, dated Apr. 7, 2010.
International Search Report for PCT/GB2009/000497, dated Jan. 22, 2010.
Smith C. R et al.: 'Application of 450 kV computed tomography to engine blocks with steel liners' Materials Evaluation vol. 65, No. 5, 2007, pp. 458-461, XP055108238.
International Search Report for PCT/US13/23676, dated Jun. 28, 2013.
International Search Report for PCT/US13/24191, Rapiscan Systems Inc., dated Jun. 25, 2013.
International Search Report for PCT/US2014/010370, dated May 13, 2014.
International Search Report for PCT/US10/58809; Rapiscan Systems Inc.; dated Apr. 19, 2011.
International Search Report for PCT/US2014/015126, dated May 27, 2014.
Written Opinion of the International Searching Authority for PCT/US2014/015126, dated May 27, 2014.
International Search Report for PCT/US2012/054110, dated Dec. 24, 2012.
International Search Report for PCT/GB2004/001729, dated Aug. 12, 2004.
International Search Report for PCT/GB2004/001741, dated Mar. 3, 2005.
International Search Report for PCT/GB2004/001731, dated May 27, 2005.
International Search Report for PCT/GB2004/001732, dated Feb. 25, 2005.
International Search Report for PCT/GB2004/1751, dated Mar. 21, 2005.
International Search Report for PCT/GB2004/001747, dated Aug. 10, 2004.
International Search Report for PCT/GB2006/004684, dated May 23, 2007.
International Search Report for PCT/GB2010/050125, dated Sep. 1, 2010.
International Search Report, PCT/GB2009/001760, dated Mar. 1, 2010, Rapiscan Systems, Inc.
International Search Report for PCT/GB2009/051178, dated May 11, 2010.
International Search Report for PCT/GB2010/050438, dated Jun. 1, 2010.
International Search Report for PCT/GB2010/050318, dated Jul. 11, 2011.
International Search Report for PCT/US2010/036183, dated Aug. 20, 2010.
International Search Report for PCT/US2010/036221, dated Aug. 23, 2010.
International Search Report for PCT/US2010/037167, dated Sep. 7, 2010.
International Search Report for PCT/US2010/036179, dated Aug. 30, 2010.
International Search Report for PCT/US2010/041871, dated Oct. 4, 2010.
International Search Report, PCT/US2012/40923, dated Sep. 21,2012, Rapiscan Systems, Inc.
International Search Report for PCT/US2011/025777, dated Jul. 26, 2011.
International Search Report for PCT/US18/27872, dated Jul. 23, 2018.
International Search Report for PCT/US2018/063651, dated Feb. 25, 2019.
International Search Report PCT/GB2008/000116, dated Nov. 17, 2009.
STMicroelectronics: "Dual Full-Bridge Driver" Datasheet for L298, 2000, pp. 1-13, XP002593095; Retrieved from the Internet: URL:http://www.st.com/stonline/products/literature/ds/1773.pdf [retrieved on Jul. 22, 2010>].
Bruder et al.: "Efficient Extended Field of View (eFOV) Reconstruction Techniques for Multi-Slice Helical CT", In: [online], Dec. 2008. Retrieved on Aug. 31, 2012 (Aug. 31, 2012). Retrieved from the Internet at URL:<http://144.206.159.178/FT/CONF/16412043/16412124.pdf>.

* cited by examiner

MULTIPLEXED DRIVE SYSTEMS AND METHODS FOR A MULTI-EMITTER X-RAY SOURCE

FIELD

The present specification is related generally to the field of Real-time Tomography. More specifically, the present specification is related to multiplexed drive systems and methods for uniquely addressing each of a plurality of cathodes or electron guns of a multi-emitter X-ray source.

BACKGROUND

Real-time Tomography (RTT) is a new generation of X-ray systems that implement multi-emitter X-ray sources with more than one cathode or electron gun and one or more high voltage anodes within a single vacuum tube, envelope or X-ray tube. In this system, a multi-emitter X-ray source allows non-sequential motion of an X-ray beam about an object under inspection through the use of multiple grid controlled cathodes which can be excited in any chosen sequence, the electron beam from each source being directed to irradiate anode sections which are distributed around the object under inspection. This allows non-helical source trajectories to be constructed at high speeds consistent with the requirements for dynamic and high-throughput object imaging. Additionally, the rapid switching of cathodes under electrostatic control enables a fast movement of the effective focal spot of the X-ray tube and rapid generation of sets of tomographic X-ray scan data without the use of moving parts.

FIG. 1A shows a prior art multi-emitter X-ray source 10 in which an anode 32 is irradiated by a set of electron guns 18, wherein the entire assembly is located within a vacuum envelope 25.

FIG. 1B shows a prior art electron gun design for the multi-emitter X-ray source 10 comprising a dispenser cathode 150 heated by a filament 155. Electrons present at the heated surface of the dispenser cathode 150 may be extracted by applying a potential difference between the cathode 150 and an adjacent grid 160. One or more focus electrodes (170, 180) shape an extracted electron beam as it passes into a high electric field region between the focus electrodes 170, 180 and the anode. Together, these elements form the electron gun 18. A number of electrical feed-throughs 190 exchange electrical signals to circuitry on a printed circuit board 195 outside the vacuum envelope 25. The circuitry is designed to provide power to the filament 155 in order to heat up the dispenser cathode 150 and to provide grid switching signals to apply a suitable potential difference between the grid 160 and the surface of the dispenser cathode 150 to enable a current to flow into the region between the focus electrodes 170, 180.

The prior art multi-emitter X-ray source uses a direct drive system to address each of a plurality of cathodes or electron guns in any arbitrary scan sequence. The required minimum number of electrical vacuum feed-throughs for the direct drive method is equal to the number of cathodes or electron guns. In addition, another set of feed-through pins is required to provide power to cathode heaters. For example, a prior art multi-emitter X-ray source having 768 cathodes or electron guns typically uses a minimum of 768 electrical vacuum feed-throughs through the wall of the X-ray tube to address each of the individual cathodes. In addition, another 48 feed-through pins are required to provide power to the cathode heaters. A provision of this number of vacuum feed-through pins requires: a) 24 32-way cathode feed-throughs, b) 24 large pull-through apertures in a pressed vacuum envelope, and c) 24 precision welding operations to install the feed-throughs parts within the envelope.

One of ordinary skill in the art would further appreciate that each vacuum feed-through, no matter how well constructed, has a probability of failure. Given the large number of feed-through pins present in the direct drive system, it is difficult to increase the probability of producing an entirely leak-free envelope simply by producing ever better feed-throughs. For example, with a 0.1% pin failure rate roughly only one tube in two will be leak-tight prior to any application of a leak sealant.

Accordingly, there is need for a multiplexed drive system for a multi-emitter X-ray source that substantially reduces a required number of vacuum feed-through pins while still enabling addressing of each of a plurality of cathodes or electron guns in any arbitrary scan sequence.

SUMMARY

The following embodiments and aspects thereof are described and illustrated in conjunction with systems, tools and methods, which are meant to be exemplary and illustrative, and not limiting in scope. The present application discloses numerous embodiments.

In some embodiments, the present specification is directed toward a multi-emitter X-ray source comprising a plurality of X-ray source modules wherein each of the plurality of X-ray source modules comprises a sub-set of a plurality of electron guns. In some embodiments, the plurality of X-ray source modules are placed end-to-end to form a continuous locus of the plurality of electron guns around a full length of the multi-emitter X-ray source.

In some embodiments, if the plurality of X-ray source modules are 'm' and each of these modules comprises a sub-set of 'n' electron guns, then there are a total of n×m electron guns in the multi-emitter X-ray source.

In some embodiments, each of the total of n×m electron guns is connected to an active circuit—an AND gate—that is activated by one of a plurality of X-address lines and one of a plurality of Y-address lines acting together. In embodiments where the plurality of X-address lines are 'm' in number and the plurality of Y-address lines are 'n' in number, one of the 'm' X-address lines is coupled to a first input of the AND gate and one of the 'n' Y-address lines is coupled to a second input of the AND gate at each of the n×m electron guns. Consequently, simultaneous activation of an X-address line and a Y-address line at a particular electron gun will result in electron emission from that electron gun.

In some embodiments, there are 24 X-address lines and 32 Y-address lines.

In some embodiments, the present specification discloses an X-ray source comprising: an X-ray tube comprising: a vacuum tube; a first plurality of wires extending in a first direction through the vacuum tube; a second plurality of wires extending in a second direction through the vacuum tube, wherein the first plurality of wires and second plurality of wires intersect to form a plurality of nodes; and a plurality of electron guns enclosed in the vacuum tube, wherein each of the plurality of electron guns is in electrical communication with at least one of the plurality of nodes; and a controller configured to modulate a state of one or more of the plurality of nodes to thereby activate or deactivate a corresponding one or more of the plurality of electron guns.

Optionally, each of the first plurality of wires intersects one of the second plurality of wires perpendicularly.

Optionally, the state of one of the plurality of nodes comprises at least one of on or off.

Optionally, when the controller turns a state of one of the plurality of nodes to on, one of the plurality of electron guns in electrical communication with the one of the plurality of nodes is activated.

Optionally, when the controller turns a state of one of the plurality of nodes to off, one of the plurality of electron guns in electrical communication with the one of the plurality of nodes is deactivated.

Optionally, the X-ray source further comprises a plurality of feed throughs in the vacuum tube, wherein each of the plurality of feed throughs is configured to receive and pass into the vacuum tube one or more of the first plurality of wires or the second plurality of wires.

Optionally, the controller further comprises a first plurality of switches configured to control a state of each of the first plurality of wires, wherein said first plurality of switches is positioned outside the vacuum tube.

Optionally, the controller further comprises a second plurality of switches configured to control a state of each of the second plurality of wires, wherein said second plurality of switches is positioned outside the vacuum tube.

Optionally, the controller modulates a state of one of the plurality of nodes by closing a first switch in electrical communication with a first wire of the first plurality of wires and closing a second switch in electrical communication with a second wire of the second plurality of wires, wherein the first wire and second wire define one of the plurality of nodes.

Optionally, the controller modulates a state of one of the plurality of nodes by opening a first switch in electrical communication with a first wire of the first plurality of wires and opening a second switch in electrical communication with a second wire of the second plurality of wires, wherein the first wire and second wire define one of the plurality of nodes.

Optionally, each of the plurality of electron guns is coupled to one or more AND gates, wherein each of the one or more AND gates comprises a first diode, a second diode and a resistor, and wherein each of the one or more AND gates is positioned inside the vacuum tube.

Optionally, a total number of the first plurality of wires is between 2 and 200 and a total number of the second plurality of wires is between 2 and 200.

Optionally, a total number of the plurality of nodes is between 4 and 4000 and a total number of the plurality of electron guns is equal to the total number of the plurality of nodes.

Optionally, each of the plurality of electron guns is uniquely controlled by only one of the plurality of nodes.

In some embodiments, the present specification is directed towards an X-ray source comprising: an enclosure; one or more electron guns enclosed in the enclosure; a first set of one or more wires extending in a first direction through the enclosure; at least one switch, of a first plurality of switches, in electrical communication with each wire of the first set of one or more wires, wherein each of the first plurality of switches is configured to uniquely control one wire of the first set of one or more wires; a second set of one or more wires extending in a second direction through the enclosure, wherein each wire of the first set of one or more wires and each wire of the second set of one or more wires intersect to form a plurality of nodes; and at least one switch, of a second plurality of switches, in electrical communication with each wire of the second set of one or more wires, wherein each of the second plurality of switches is configured to uniquely control one wire of the second set of one or more wires and wherein each of the plurality of electron guns is in electrical communication with one of the plurality of nodes such that each of the plurality of electron guns is configured to activate or deactivate based on a state of one of the plurality of nodes.

Optionally, each wire of the first set of one or more wires intersects each wire of the second set of one or more wires perpendicularly.

Optionally, the state of one of the plurality of nodes comprises at least one of on or off.

Optionally, the state of one of the plurality of nodes consists of on or off.

Optionally, when the state of one of the plurality of nodes is on, one of the plurality of electron guns uniquely modulated by said one of the plurality of nodes is activated.

Optionally, when the state of one of the plurality of nodes is off, one of the plurality of electron guns uniquely modulated by said one of the plurality of nodes is deactivated.

Optionally, the X-ray source further comprises a plurality of feed throughs in the enclosure, wherein each of the plurality of feed throughs is configured to receive and pass into the enclosure one or more of the first set of one or more wires or the second set of one or more wires.

Optionally, each of the first plurality of switches and the second plurality of switches are positioned outside the enclosure.

Optionally, the state of one of the plurality of nodes is modulated by closing a switch of the first plurality switches in electrical communication with a first wire of the first set of one or more wires and closing a switch of the second plurality of switches in electrical communication with a second wire of the second set of one or more wires, wherein the first wire of the first set of one or more wires and the second wire of the second set of one or more wires together define the one of the plurality of nodes.

Optionally, the state of one of the plurality of nodes is modulated by opening a switch of the first plurality switches in electrical communication with a first wire of the first set of one or more wires and opening a switch of the second plurality of switches in electrical communication with a second wire of the second set of one or more wires, wherein the first wire of the first set of one or more wires and the second wire of the second set of one or more wires together define the one of the plurality of nodes.

Optionally, each of the plurality of electron guns is coupled to one or more AND gates, wherein each of the one or more AND gates comprises a first diode, a second diode and a resistor, and wherein each of the one or more AND gates is positioned inside the enclosure.

Optionally, a total number of the first set of one or more wires is between 2 and 200 and a total number of the second set of one or more wires is between 2 and 200.

Optionally, a total number of the plurality of nodes is between 4 and 4000 and a total number of the plurality of electron guns is equal to the total number of the plurality of nodes.

Optionally, the enclosure has an internal pressure level below atmospheric pressure.

Optionally, the enclosure has an internal pressure level below 1 atm.

In some embodiments, the present specification discloses an X-ray source comprising: a vacuum housing; a plurality of electron guns; a plurality of modules, wherein each of the plurality of modules comprises one or more of the plurality of electron guns and wherein the plurality of modules are placed end-to-end to form a continuous locus of the plurality of electron guns within the vacuum housing; a first plurality of address lines extending through the vacuum housing; a second plurality of address lines extending through the vacuum housing, wherein the first plurality of address lines and the second plurality of address lines intersect at a plurality of nodes, wherein each of the plurality of electron guns is in electrical communication with one of the plurality of nodes such that a state of each of the plurality of electron guns is uniquely controlled by one of the first plurality of address lines and one of the second plurality of address lines; a first multi-pin vacuum feed-through containing the first plurality of address lines; and a second multi-pin vacuum feed-through containing the second plurality of address lines.

Optionally, the state of each of the plurality of electron guns comprises on or off.

Optionally, the first plurality of address lines comprise a 'm' number of address lines, the second plurality of address lines comprise a 'n' number of address lines, the plurality of nodes comprise 'n×m' nodes and the plurality of electron guns comprise 'n×m' electron guns.

Optionally, m=24 and n=32.

Optionally, the first multi-pin vacuum feed-through contains a 'm' number of address lines and the second multi-pin vacuum feed-through contains a 'n' number of address lines such that 'n+m' number of feed-throughs penetrate a wall of the vacuum housing.

Optionally, m=24 and n=32.

Optionally, each of the plurality of modules has associated common grid support electrodes.

Optionally, each of the first plurality of address lines is coupled to one of a first plurality of switches and each of the second plurality of address lines is coupled to one of a second plurality of switches and wherein the first plurality of switches and the second plurality of switches are positioned outside the vacuum housing.

Optionally, an electron gun of the plurality of electron guns is activated by closing one of the first plurality of switches and one of the second plurality of switches respectively coupled to one of the first plurality of address lines and one of the second plurality of address lines associated with said electron gun.

Optionally, each of the plurality of electron guns is connected to one of a plurality of AND gates, wherein each of the plurality of AND gates are positioned within the vacuum housing, and wherein each of the plurality of AND gates is controlled by modulating a state of one of the first plurality of address lines and one of the second plurality of address lines.

Optionally, each of the plurality of AND gates comprises a first diode, a second diode and a resistor.

Optionally, a total number of the first plurality of address lines is between 2 and 200 and a total number of the second plurality of address lines is between 2 and 200.

Optionally, a total number of the plurality of nodes is between 4 and 4000 and a total number of the plurality of electron guns is equal to the total number of the plurality of nodes.

The aforementioned and other embodiments of the present shall be described in greater depth in the drawings and detailed description provided below.

BRIEF DESCRIPTION OF THE DRAWINGS

These and other features and advantages of the present specification will be further appreciated, as they become better understood by reference to the following detailed description when considered in connection with the accompanying drawings.

DETAILED DESCRIPTION

Figure 1A:
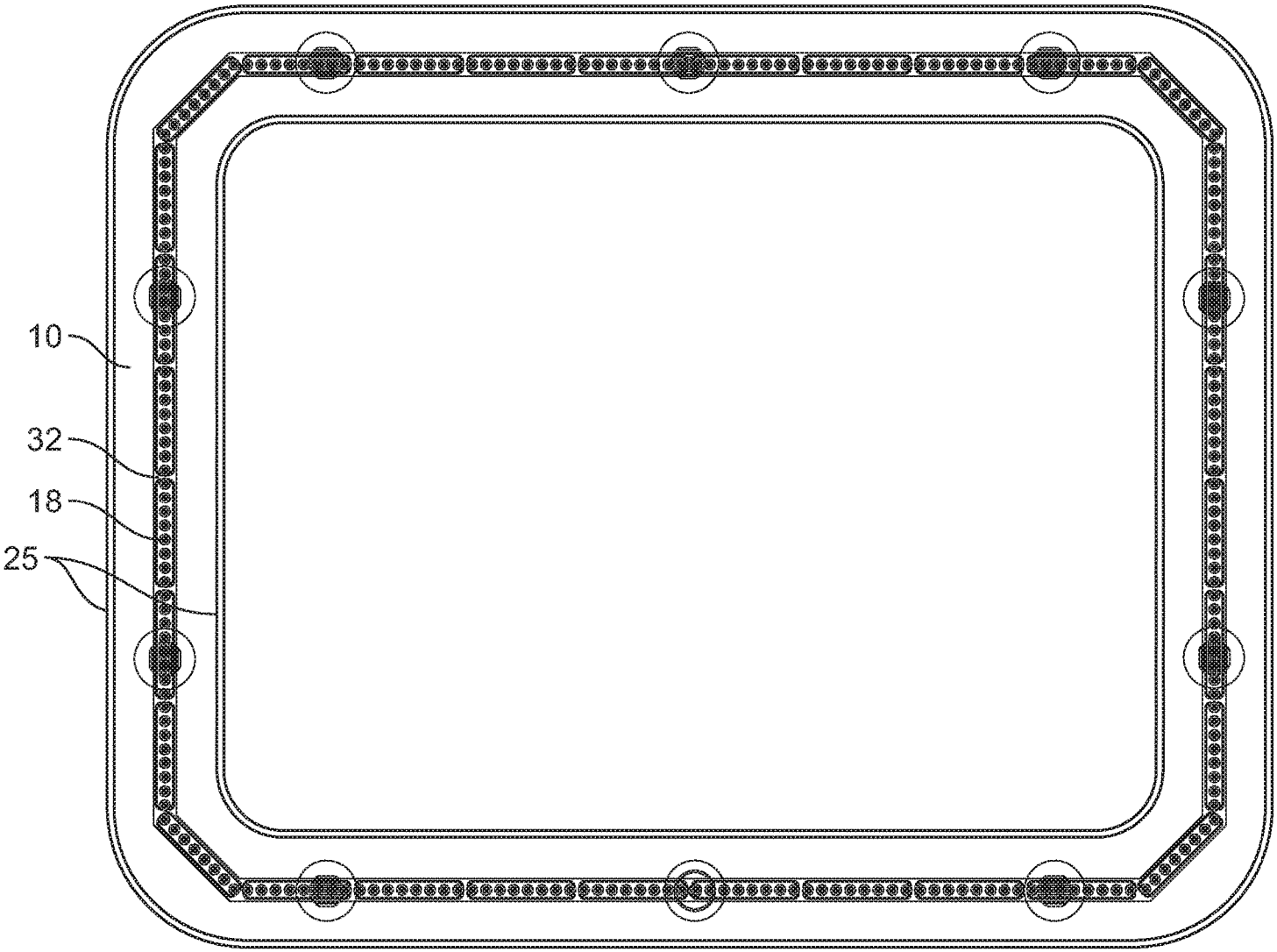
FIG. 1A (Prior Art)
FIG. 1A illustrates a prior art multi-emitter X-ray source.
Figure 1B:
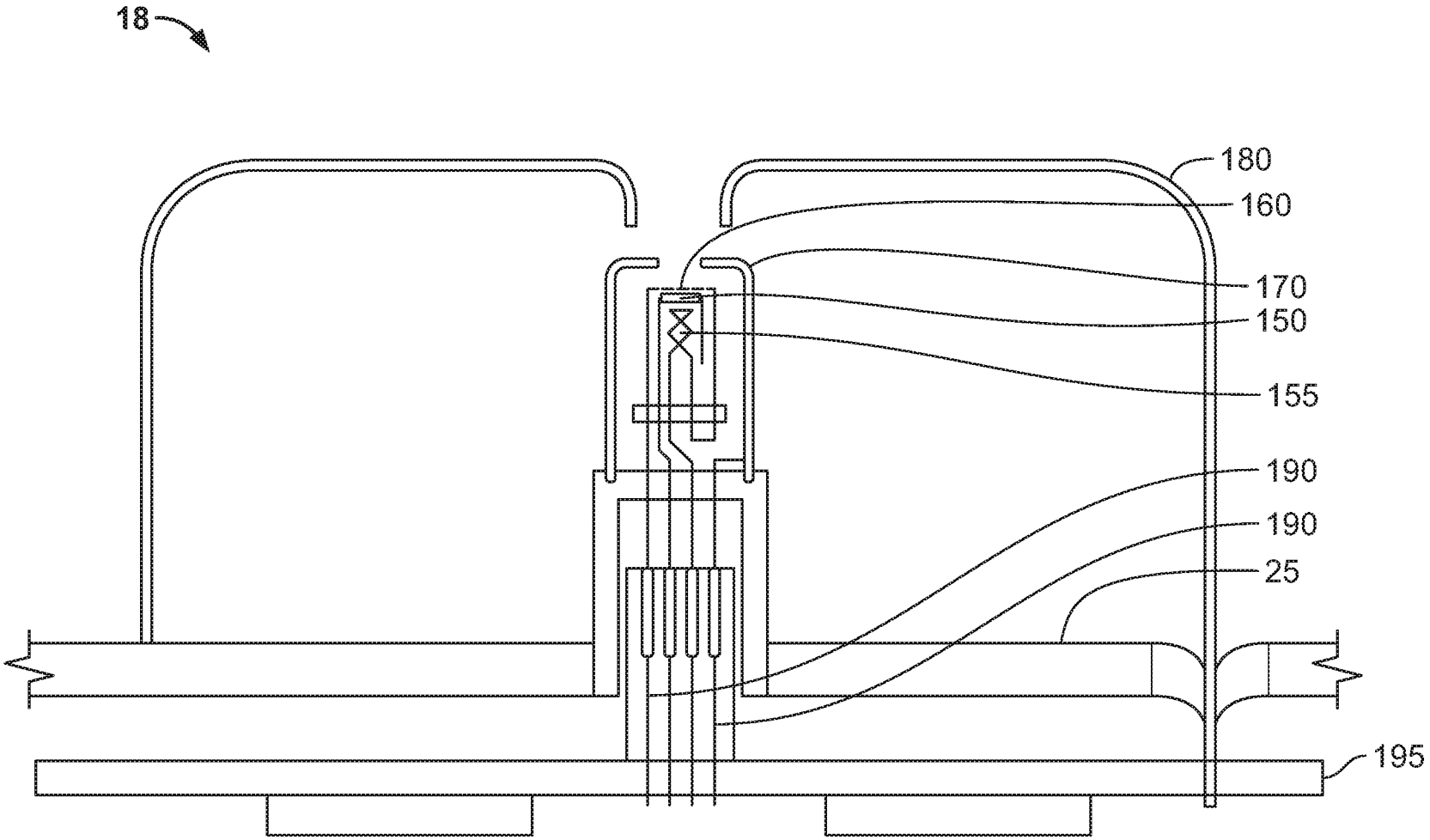
FIG. 1B (Prior Art)
FIG. 1B shows a prior art electron gun design for the multi-emitter X-ray source.

The present specification discloses a multiplexed drive system comprising a plurality of X-address lines and a plurality of Y-address lines to uniquely address each of a plurality of cathodes within individual electron guns encapsulated in a vacuum housing, tube or envelope of a multi-emitter X-ray source. In embodiments, the plurality of X-address lines may also be interchangeably referred to as row address lines. In embodiments, the plurality of X-address lines may also be interchangeably referred to as column address lines. In embodiments, each of the plurality of cathodes is positioned at an intersection of an X-address line and a Y-address line. Each of the plurality of cathodes is uniquely enabled/disabled (switched on/off) by using an AND gate (virtual or real) at each of the plurality of intersections.

In embodiments, use of the multiplexed drive results in a significant reduction in the number of vacuum feed-throughs required to drive the plurality of cathodes compared to the number of vacuum feed-throughs required for the same plurality of cathodes in prior art multi-emitter X-ray sources.

The present specification is directed towards multiple embodiments. The following disclosure is provided in order to enable a person having ordinary skill in the art to practice the invention. Language used in this specification should not be interpreted as a general disavowal of any one specific embodiment or used to limit the claims beyond the meaning of the terms used therein. The general principles defined herein may be applied to other embodiments and applications without departing from the spirit and scope of the invention. Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention.

In the description and claims of the application, each of the words "comprise" "include" and "have", and forms thereof, are not necessarily limited to members in a list with which the words may be associated. It should be noted herein that any feature or component described in association with a specific embodiment may be used and implemented with any other embodiment unless clearly indicated otherwise.

As used herein, the indefinite articles "a" and "an" mean "at least one" or "one or more" unless the context clearly dictates otherwise.

It should further be appreciated that the control functionalities described herein, including the activation or deactivation of current through or to any wires, nodes, and/or electron guns, are effectuated through a controller. The controller may comprise a processor, memory, and/or any of the specifically designated hardware components described herein, as required to achieve the described functions. Furthermore, the controller may be centralized onto a single board or distributed among a plurality of components that are physical separate, but in electrical and/or data communication with each other.

A Multiplexed Drive for a Multi-Emitter X-Ray Tube or Source

Figure 2A:
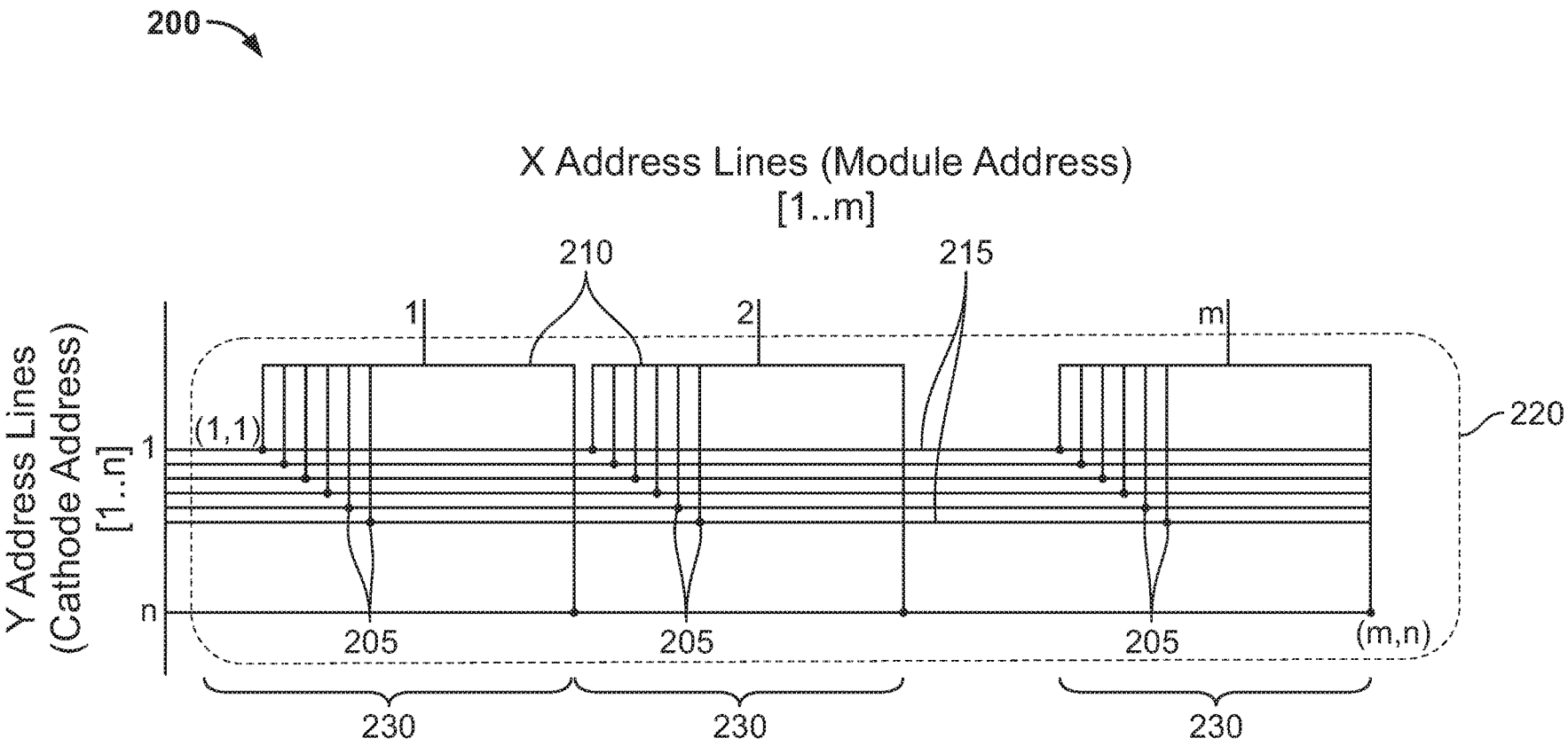
FIG. 2A illustrates a plurality of cathodes (within respective electron guns) addressed by a Module-Cathode addressing system, in accordance with some embodiments of the present specification.

FIG. 2A illustrates a plurality of cathodes 205 (within respective electron guns) enabled by a Module-Cathode addressing system 200, in accordance with some embodiments of the present specification. The system 200 comprises a first plurality of electrically conductive address lines 210 (also referred to as the X-address or Module address lines) extending in a first direction and a second plurality of electrically conductive address lines 215 (also referred to as the Y-address or Cathode address lines) extending in a second direction. The first and second plurality of electrically conductive address lines 210, 215 are enclosed in a vacuum tube, housing or envelope 220 (also referred to as a multi-emitter X-ray source 220) with the address lines 210, 215 extending through the vacuum tube, housing or envelope 220.

It should be appreciated that, in various embodiments, the multi-emitter X-ray source 220 comprises a plurality of X-ray source modules 230 wherein each of the plurality of X-ray source modules 230 comprises a sub-set of a plurality of electron guns (with respective cathodes 205). In other words, if the plurality of X-ray source modules 230 are 'm' and each of these modules 230 comprises a sub-set of 'n' electron guns (or cathodes 205), then there are a total of n×m electron guns (or cathodes 205) in the multi-emitter X-ray source 220. In embodiments, the plurality of X-ray source modules 230 are placed end-to-end to form a continuous locus of the plurality of electron guns around a full length of the multi-emitter X-ray source 220.

The X and Y-address lines 210, 215 intersect each other at a plurality of address nodes. Each of the plurality of address nodes is connected to one of the plurality of cathodes 205. Thus, in embodiments where the X-address lines 210 are 'm' in number and the Y-address lines 215 are 'n' in number, these enable n×m cathodes positioned at n×m address nodes. For example, if there were 24 X-address lines 210 and 32 Y-address lines 215, a total of 32×24=768 cathodes (of respective electron guns) can be enabled or controlled. In one embodiment, a range of 4 to 4000 electron guns are individually and uniquely addressed by the Module and Cathode address lines 210, 215 wherein the number of the Module address lines 210 is in a range of 2 to 200, and every increment therein, and the number of the Cathode address lines 215 is in a range of 2 to 200, and every increment therein.

Figure 2B:
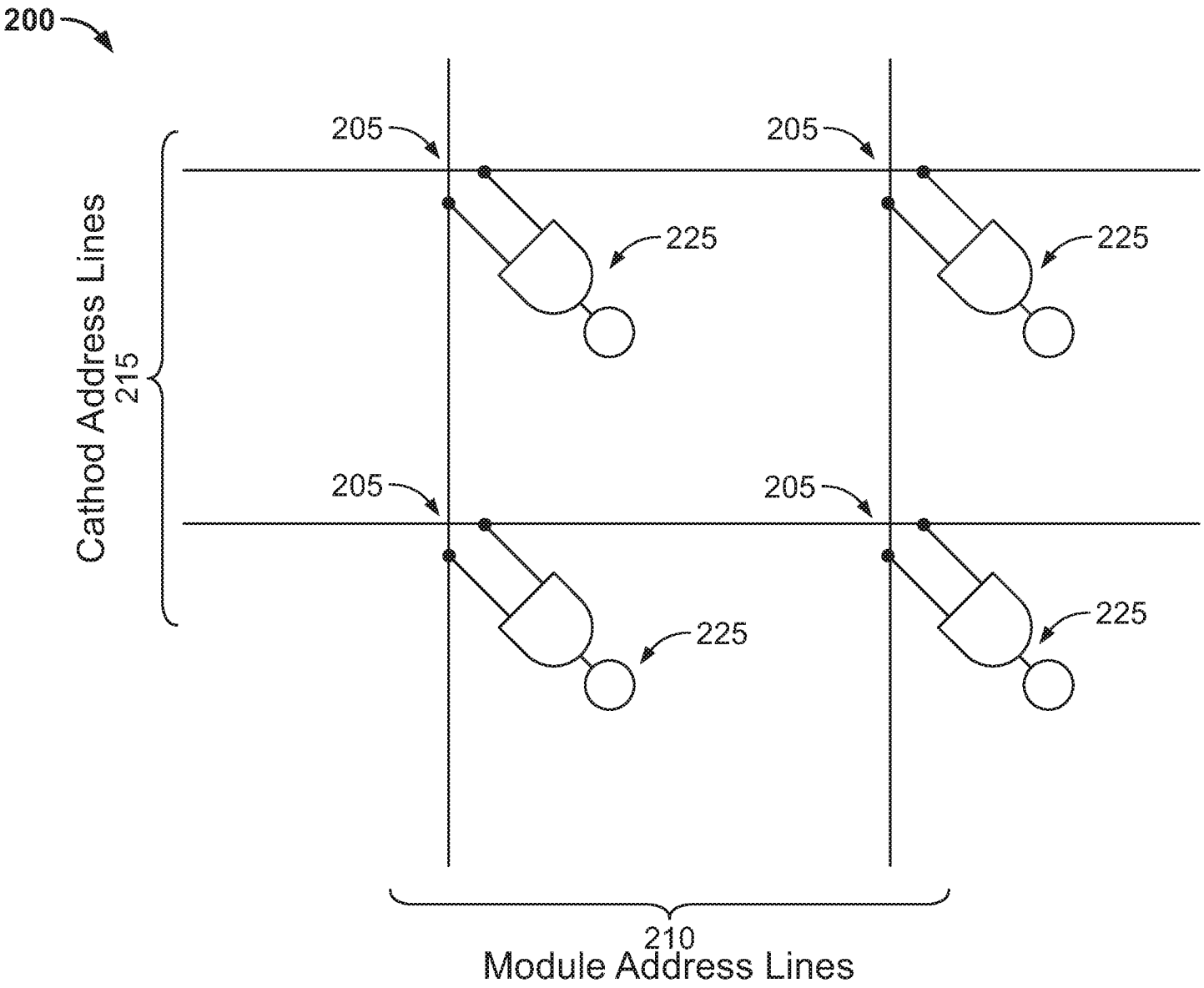
FIG. 2B illustrates an AND gate coupled to each of the plurality of cathodes of FIG. 2A, in accordance with some embodiments of the present specification.

In accordance with aspects of the present specification, a specific cathode 205 is enabled only when both Module and Cathode address lines 210, 215 associated with and feeding that cathode 205 are enabled. As shown in FIG. 2B, AND gates 225 are included at the cathode positions 205 such that each AND gate 225 (at each cathode position 205) connects to one Module address line 210 and one Cathode address line 215. Stated differently, each of the electron guns associated with the respective cathode positions 205 is connected to an active circuit—an AND gate 225—that is activated, enabled or controlled by two independent address lines 210, 215 acting together. In embodiments where the X-address lines 210 are 'm' in number and the Y-address lines 215 are 'n' in number, one of the 'm' X-address lines 210 is coupled to a first input of the AND gate 225 and one of the 'n' Y-address lines 215 is coupled to a second input of the AND gate 225 at each electron gun associated with the respective cathode positions 205. Consequently, simultaneous activation of an X-address line 210 and a Y-address line at a particular electron gun will result in electron emission from that electron gun.

Referring back to FIG. 2A, in accordance with aspects of the present specification, in some embodiments, all of the first plurality of 'm' Module address lines 210 may be contained in a first multi-pin vacuum feed-through while all of the second plurality of 'n' Cathode address line 215 may be contained in a second multi-pin vacuum feed-through. In alternative embodiments, the 'm' Module address lines 210 may be distributed over two or more multi-pin feed-throughs and the 'n' Cathode address lines 215 may also be distributed over two or more multi-pin feed-throughs. Thus, there will be n+m feed-throughs penetrating the wall of the vacuum tube or envelope 220 to control a set of n×m cathodes 205 contained in the tube or envelope 220. It should be appreciated that, in various embodiments, the n+m number of feed-throughs can be arranged around the vacuum tube or envelope 220 in any convenient and logical manner that would be evident to persons of ordinary skill in the art.

As an illustration, for example, for n=32 and m=24, the number of individually controllable cathodes will be n×m=32×24=768 and the total number of feed-throughs will be 32+24=56. It should be appreciated that the 56 feed-throughs required are significantly less in comparison to a prior art multi-emitter X-ray source that requires one feed-through per cathode—that is, in the current illustration, 768 feed-throughs for the 768 cathodes.

Thus, in embodiments of the present specification, a plurality of Module address and Cathode address lines 210, 215 along with a plurality of AND gates 225 at a plurality of junctions of the Module and Cathode address lines 210, 215 uniquely address and enable/disable (that is, switch on/off) any cathode and its associated electron gun, from the plurality of cathodes 205 and their associated electron guns.

Use of uniquely addressable cathodes 205, in multi-emitter X-ray sources, has a plurality of advantages such as, for example: a) a significant reduction in the number of vacuum feed-throughs for a given number of cathodes compared to prior art multi-emitter X-ray sources where the total number of feed-throughs required are typically equal to the total number of cathodes. The substantial reduction in the number of vacuum feed-throughs concomitantly reduces the probability of feed-through leaks, b) a significant reduction in the number of drive units or drive electronics required to enable or actuate (that is, switch on/off) the cathodes, and c) reduction in the overall cost of fabricating the multi-emitter X-ray sources owing to a) and b) above.

In Vacua AND Gates

In embodiments, for a multiplexed drive to be functional, a plurality of AND gates must exist (one for each cathode) within an X-ray tube, vacuum tube or envelope of a multi-emitter X-ray source. It should be appreciated, that the plurality of AND gates will be subjected to all processes required to manufacture a multi-emitter X-ray source tube—that is UHV (Ultra High Voltage) and a 450° C. bake-out (non-functioning). During a lifetime of the multi-emitter X-ray source tube the AND gates will be subjected to very high radiation levels, flash-over events and moderately high temperatures (~100° C.). In addition, the AND gates themselves should not contaminate the UHV interior of the multi-emitter X-ray source tube with particulates or release elements detrimental to the dispenser cathodes or electron guns.

Switch AND Gate (a 'Virtual AND Gate')

In some embodiments, the AND gate function is enabled using a plurality of switches. As known to persons of ordinary skill in the art, switches are electrical components that can make or break an electrical circuit, interrupting the current or diverting it from one conductor to another.

Figure 3A:
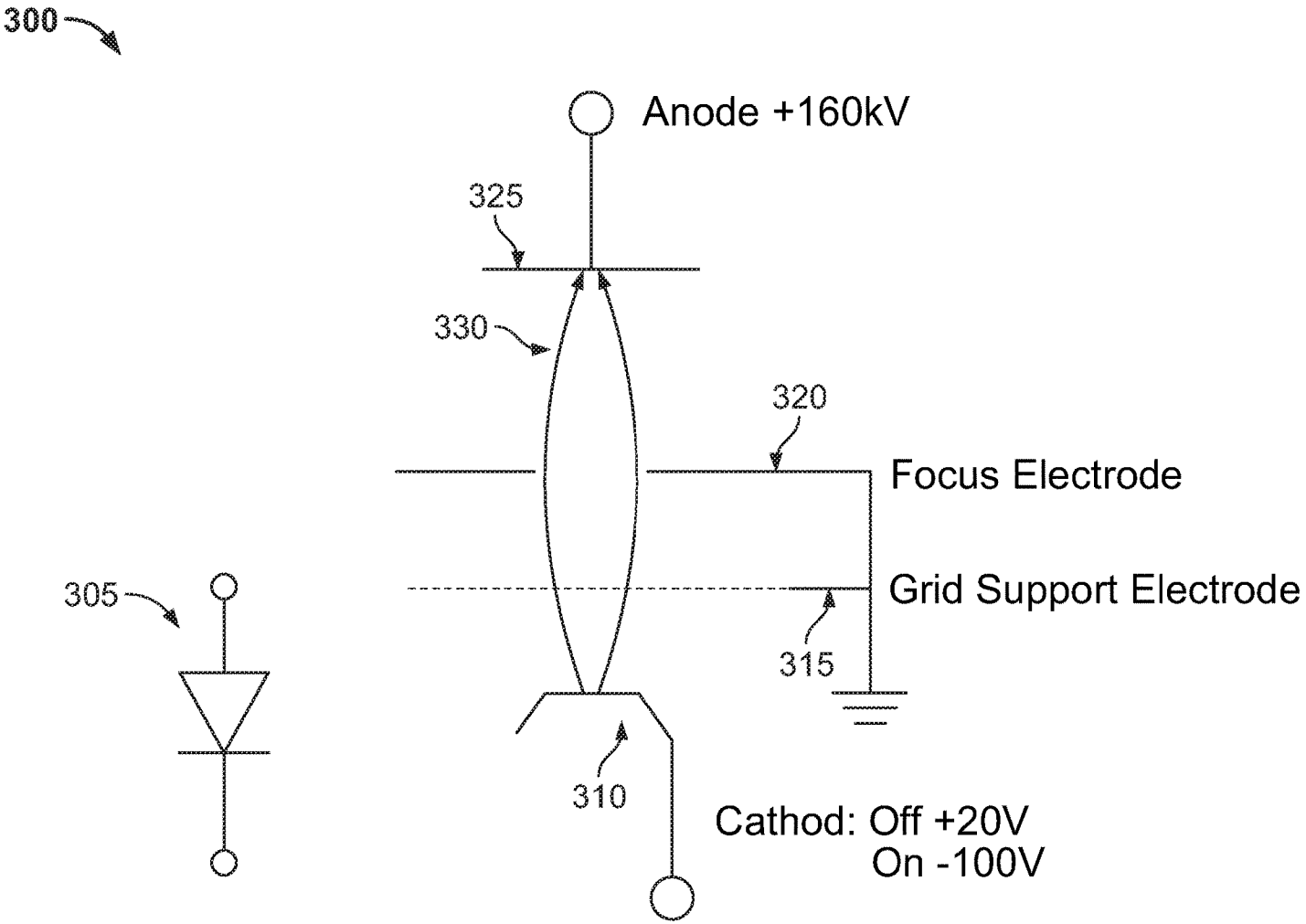
FIG. 3A illustrates an arrangement of an electron gun or cathode assembly and its diode equivalent for a prior art multi-emitter X-ray source.

FIG. 3A illustrates an arrangement of an electron gun or cathode assembly 300 and its diode equivalent 305 for a prior art multi-emitter X-ray source. The assembly 300 comprises a cathode 310 and an anode 325. A grid support electrode 315 is positioned proximate the cathode 310 while a focus electrode 320 is positioned distal from the cathode 310 and beyond the grid support electrode 315 with reference to the cathode 310. In some embodiments, switching on of a beam 330 of electrons (emanating from the cathode 310) to impinge upon the anode 325 is affected by modulating the potential of the cathode 310 from a positive value, say +20V, to a negative value, say −100V, with respect to the grid support electrode 315 that is earthed while maintaining the anode 325 at a high positive value, say 160V, with respect to the cathode 310.

Persons of ordinary skill in the art would appreciate that the cathode-grid combination of the assembly 300 effectively behaves as the diode 305 which needs to be forward biased in order to conduct.

Figure 3B:
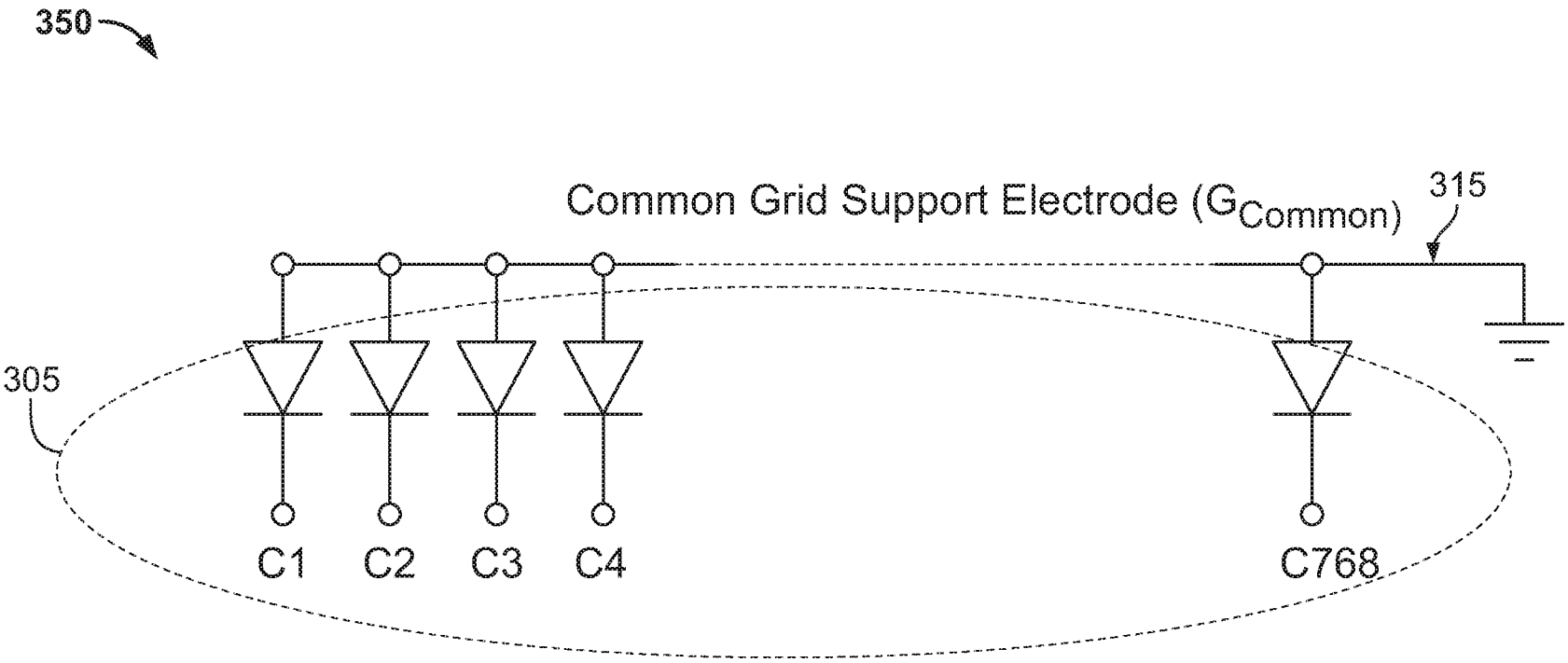
FIG. 3B illustrates a direct drive system as a diode equivalent circuit in a prior art multi-emitter X-ray source.

In prior art multi-emitter X-ray source, that requires one feed-through per cathode, the grid support electrode 315 is permanently connected to earth. Referring to FIG. 3B, this means that for a prior art multi-emitter X-ray source comprising a plurality of (say, 768) cathodes all the plurality of (768) equivalent cathode-grid diodes 305 have one common grid support electrode 315, that is earthed. An equivalent diode configuration 350 of FIG. 3B, comprising the plurality of equivalent cathode-grid diodes 305 having one common earthed grid support electrode 315, is also referred to as a direct drive arrangement.

The configuration 350 does not enable a multiplexed drive of the present specification due to the commonality of the grid support electrode 315. To enable a multiplexed drive, the common grid support electrode 315 needs to be isolated from earth and subdivided into a plurality of separate or discrete grid support electrodes, in accordance with some embodiments. In some embodiments, a number of the plurality of separate or discrete grid support electrodes $G_n$(n being positive integers) is equal to the number of Module address lines. For example, referring back to FIG. 2A, if the number of Module address lines 210 is 'm' (say, 24) then the plurality of separate or discrete electrodes $G_n$ will also be 'm' (that is, 24).

Figure 4:
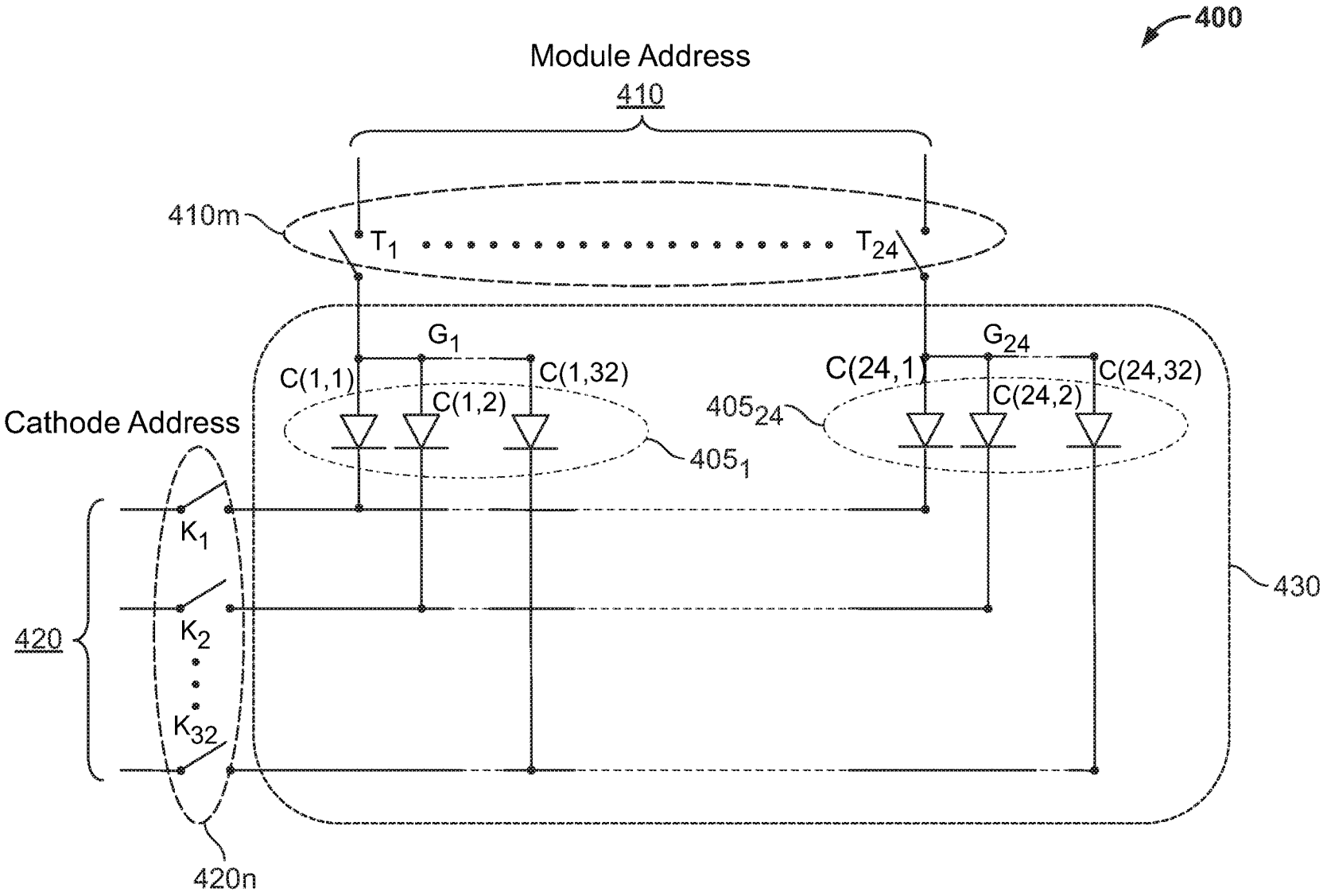
FIG. 4 illustrates a multiplexed drive system, in accordance with some embodiments of the present specification.

FIG. 4 illustrates a multiplexed drive system 400 using a plurality of discrete grid support electrodes $G_n$, in accordance with some embodiments of the present specification. The arrangement 400 shows a plurality of diodes 405 each representative of a cathode-grid combination (such as, of each of the cathode 205 of FIG. 2A). Each of a first plurality of switches $\mathbf{410}_m$ is incorporated in each of a first plurality of Module address lines 410 (or X-address lines) and each of a second plurality of switches $\mathbf{420}_n$ is incorporated in each of a second plurality of Cathode address lines 420 (or Y-address lines). The AND function is enabled from the switches $\mathbf{410}_m$ and $\mathbf{420}_n$ being activated in series. It should also be appreciated that, in embodiments, the first and second plurality of switches $\mathbf{410}_m$ and $\mathbf{420}_n$ lie outside the vacuum tube or envelope 430.

In one embodiment, as shown in FIG. 4, 24 switches $\mathbf{410}_1$ to $\mathbf{410}_{24}$ are incorporated in 24 Module address lines 410 while 32 switches $\mathbf{420}_1$ to $\mathbf{420}_{32}$ are incorporated in 32 Cathode address lines 420. All cathodes at the intersection of a Module address line 410 with all of the plurality of Cathode address lines 420 have a common grid support electrode $G_n$(also referred to as a discrete electrode). Thus, the total number of the common grid support electrodes $G_n$ is equal to the plurality of Module address lines 410 (or, in other words, equal to the plurality of X-ray source modules 230 of FIG. 2A).

For example, considering the embodiment of FIG. 4, the first Module address line $\mathbf{410}_{x1}$ intersects the 32 Cathode address lines $\mathbf{420}_{y1}$ to $\mathbf{420}_{y32}$ for a group of 32 cathodes $\mathbf{405}_1$ each of which can be addressed as C (1, 1), C (1, 2) up to C(1, 32). This group of 32 cathodes $\mathbf{405}_1$ has a common grid support electrode $G_1$. Similarly, the twenty-fourth Module address line $\mathbf{410}_{x24}$ intersects the 32 Cathode address lines $\mathbf{420}_{y1}$ to $\mathbf{420}_{y32}$ for a group of 32 cathodes $\mathbf{405}_{24}$ each of which can be addressed as C(24, 1), C(24, 2) up to C(24, 32). This other group of 32 cathodes $\mathbf{405}_{24}$ also has a common grid support electrode $G_{24}$.

An AND function for a cathode is enabled by closing the switches $\mathbf{410}_m$, $\mathbf{420}_n$ in the Module address and Cathode address lines associated with the cathode. For example, in order to activate cathode C (1, 32) in FIG. 4, the Module address line switch $\mathbf{410}_1$ and the Cathode address line switch $\mathbf{420}_{32}$ must be closed to complete the circuit. The addressing of the cathode C(1, 32) is unique since none of the other 767 cathodes are enabled.

TABLE A

| Potential in Module address line 410 | Potential in Cathode address line 420 | Emission? |
|---|---|---|
| +20 V | +20 V | No |
| +20 V | −100 V | Yes |
| −120 V | +20 V | No |
| −120 V | −100 V | No |

As can be observed in Table A, emission only occurs when the grid support electrode is at positive potential with respect to the cathode and when both the cathode 310 and grid support electrode are at negative potential with respect to the focus electrode.

During operation, a $V_{on}$ or $V_{off}$ potential is applied to a Module address and a Cathode address line in order to enable or switch on an associated cathode at the junction of the Module and Cathode address lines. In some embodiments, for the Module address lines $V_{on}$ is 0V while $V_{off}$ is −120V. Similar $V_{on}$ and $V_{off}$ potentials are used for the Cathode address lines.

As is evident from FIG. 4, there are no active switching elements (410$_m$ or 420$_n$) within the vacuum tube or envelope 430 which could degrade or contaminate the tube 430. Also, the total number of feed-throughs for the embodiment of FIG. 4 is 56 (=24 Module address lines+32 Cathode address lines).

Diode-Resistor AND Gate (a 'Real AND Gate')

In some embodiments, actual in vacua AND gates are used at the plurality of intersections of Module address and Cathode address lines.

Figure 5:
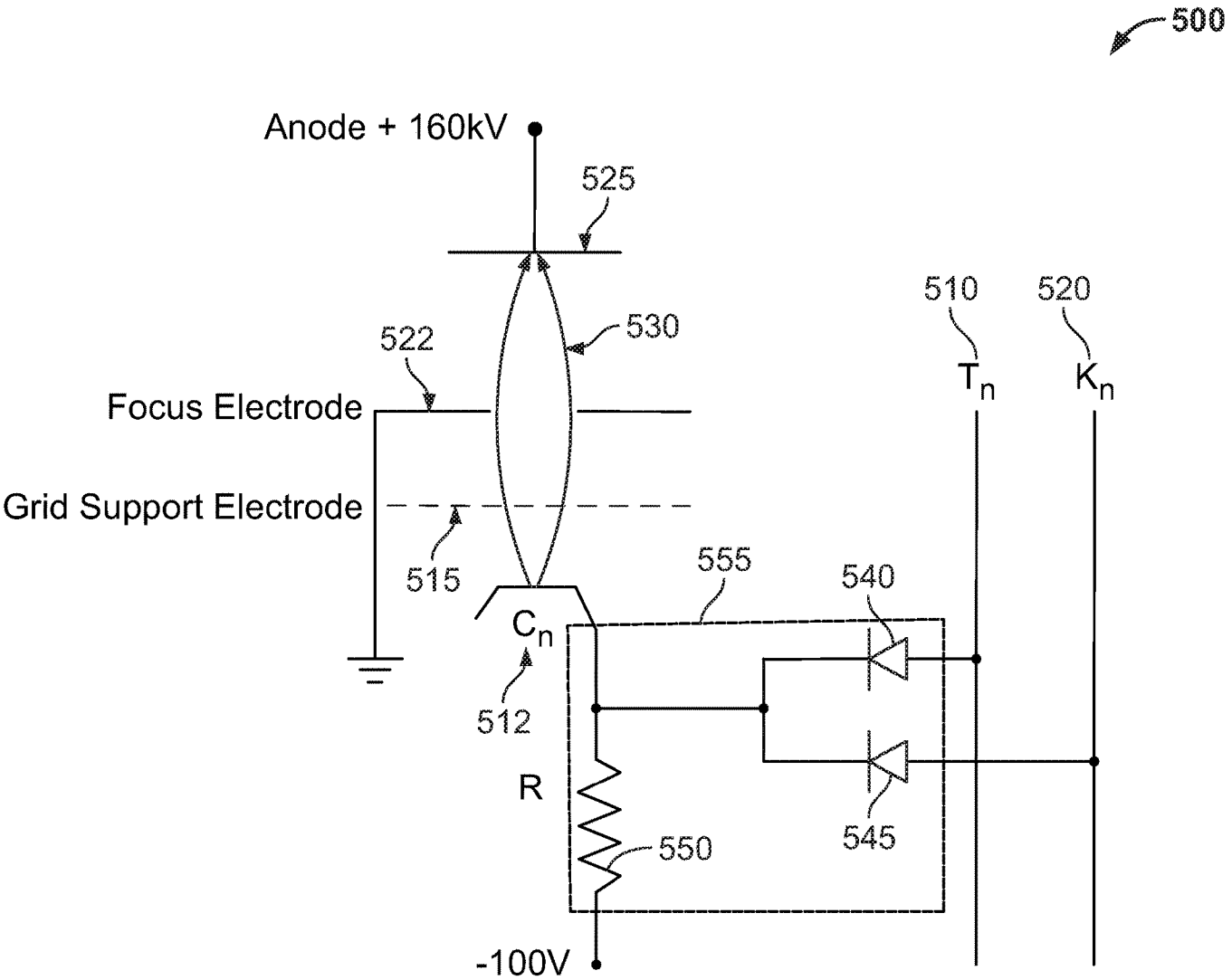
FIG. 5 illustrates a multiplexed drive system of an electron gun or cathode assembly, in accordance with some embodiments of the present specification.

FIG. 5 illustrates a multiplexed drive system of an electron gun or cathode assembly 500 using a diode-resistor AND gate, in accordance with some embodiments of the present specification. The assembly 500 comprises a cathode 512 and an anode 525. A grid support electrode 515 is positioned proximate the cathode 512 while a focus electrode 522 is positioned distal from the cathode 512 and beyond the grid support electrode 515 with reference to the cathode 310. In some embodiments, switching on of a beam 530 of electrons (emanating from the cathode 512) to impinge upon the anode 525 is affected by modulating the potential of the cathode 512 from a positive value, say +20V, to a negative value, say −100V, with respect to the grid support electrode 515 that is earthed while maintaining the anode 525 at a high positive value, say 160V, with respect to the cathode 512.

In accordance with an aspect of the present specification, an AND gate 555 is formed from an arrangement comprising first and second diodes 540, 545 and a resistor 550. In some embodiments, the first and second diodes 540, 545 are silicon diodes and the resistor 550 is of a suitable metal oxide. It should be appreciated that silicon diodes are available which have been encapsulated in glass and can survive a 450° C. bake-out. In some embodiments, the components of the AND gate 555—that is, the first and second diodes 540, 545 and the resistor 550, are spot-welded to a ceramic circuit board.

As shown in FIG. 5, the AND gate 555 is attached to the cathode 512. In other words, for a multi-emitter X-ray source, an AND gate, such as gate 555, is connected, attached or coupled to each of a plurality of cathodes positioned at the intersections of a plurality of Module address and Cathode address lines.

As shown in FIG. 5, the first diode 540 has a Module address line 510 as input while the second diode 545 has a Cathode address line 520 as input. The following Table A shows how the potential at the cathode 512 varies with the modulation of the Module address and Cathode address lines 510, 520:

TABLE B

| Potential in Module address line 510 | Potential in Cathode address line 520 | Potential at cathode 512 |
|---|---|---|
| +20 V | +20 V | +20 V |
| +20 V | −100 V | +20 V |
| −100 V | +20 V | +20 V |
| −100 V | −100 V | −100 V |

As can be observed from Table B, the cathode 512 is enabled (to emanate the electron beam 530) only when both the Module address and Cathode address lines 510, 520 are at a negative potential (for example −100V with respect to the focus electrode 522).

However, an issue with the AND gate 555 is its power consumption. In order to be able to drive at least 40 mA into the cathode 512 in an on-state, the value of the resistor 550 cannot exceed 250Ω. When in an off-state, a voltage of 120V exists across the resistor 550 which then draws approximately 0.5 A from the address lines and dissipates 60 W. Therefore, in alternate embodiments, a transistor (such as, for example, JFET, MOSFET or Bipolar) is included into each gate 555 to provide current amplification.

An advantage of the multiplexed drive system of FIG. 4 is the reduction in the quantity of drive electronics required for an X-ray tube, vacuum tube or envelope. The direct drive arrangement of FIG. 3B uses a serial repetition of drive electronics which, for most of a scan, are in the off-state. In contrast, a multiplexed drive system uses one set of drive electronics which is switched between modules and thus is in a continual state of use. In some embodiments, a multiplexed X-ray tube or multi-emitter X-ray source requires only two drive boards conveniently situated for ease of replacement.

Thus, the multiplexed drive systems of the present specification enable each of a plurality of cathodes to be addressed in any arbitrary scan sequence while using a substantially reduced number of vacuum feed-through pins. For example, a multi-emitter X-ray source comprising 768 cathodes requires 56 vacuum feed-through pins for a multiplexed drive. This number of pins could be accommodated by two feed-throughs, in some embodiments. Also, the pull-through and welding operations required to connect a feed-through to the X-ray tube vacuum envelope also drop to two. Perhaps more importantly, considering a 0.1% pin failure rate, 95% of the X-ray tubes are highly likely to be leak-tight after bake-out.

The above examples are merely illustrative of the many applications of the system and method of present specification. Although only a few embodiments of the present specification have been described herein, it should be understood that the present specification might be embodied in many other specific forms without departing from the spirit or scope of the specification. Therefore, the present examples and embodiments are to be considered as illustrative and not restrictive, and the specification may be modified within the scope of the appended claims.

We claim:

1. An X-ray source comprising:

an X-ray tube comprising:

a vacuum tube;

a first plurality of wires extending in a first direction through the vacuum tube;

a second plurality of wires extending in a second direction through the vacuum tube, wherein the first plurality of wires and second plurality of wires intersect to form a plurality of nodes; and a plurality of electron guns enclosed in the vacuum tube, wherein each of the plurality of electron guns is in electrical communication with at least one of the plurality of nodes; and a controller configured to modulate a state of one or more of the plurality of nodes to thereby activate or deactivate a corresponding one or more of the plurality of electron guns, wherein the controller further comprises a first plurality of switches configured to control a state of each of the first plurality of wires and a second plurality of switches configured to control a state of each of the second plurality of wires, wherein said first plurality of switches and said second plurality of switches are positioned outside the vacuum tube.

2. The X-ray source of claim 1, wherein each of the first plurality of wires intersects one of the second plurality of wires perpendicularly.

3. The X-ray source of claim 1, wherein the state of one of the plurality of nodes comprises at least one of on or off.

4. The X-ray source of claim 3, wherein, when the controller turns a state of one of the plurality of nodes to on, one of the plurality of electron guns in electrical communication with the one of the plurality of nodes is activated.

5. The X-ray source of claim 3, wherein, when the controller turns a state of one of the plurality of nodes to off, one of the plurality of electron guns in electrical communication with the one of the plurality of nodes is deactivated.

6. The X-ray source of claim 1 further comprising a plurality of feed throughs in the vacuum tube, wherein each of the plurality of feed throughs is configured to receive and pass into the vacuum tube one or more of the first plurality of wires or the second plurality of wires.

7. The X-ray source of claim 1, wherein the controller modulates a state of one of the plurality of nodes by closing a first switch in electrical communication with a first wire of the first plurality of wires and closing a second switch in electrical communication with a second wire of the second plurality of wires, wherein the first wire and second wire define one of the plurality of nodes.

8. The X-ray source of claim 1, wherein the controller modulates a state of one of the plurality of nodes by opening a first switch in electrical communication with a first wire of the first plurality of wires and opening a second switch in electrical communication with a second wire of the second plurality of wires, wherein the first wire and second wire define one of the plurality of nodes.

9. The X-ray source of claim 1, wherein each of the plurality of electron guns is coupled to one or more AND gates, wherein each of the one or more AND gates comprises a first diode, a second diode and a resistor, and wherein each of the one or more AND gates is positioned inside the vacuum tube.

10. The X-ray source of claim 1, wherein a total number of the first plurality of wires is between 2 and 200 and a total number of the second plurality of wires is between 2 and 200.

11. The X-ray source of claim 10, wherein a total number of the plurality of nodes is between 4 and 4000 and a total number of the plurality of electron guns is equal to the total number of the plurality of nodes.

12. The X-ray source of claim 1, wherein each of the plurality of electron guns is uniquely controlled by only one of the plurality of nodes.

13. An X-ray source comprising:

an enclosure;

a plurality of electron guns enclosed in the enclosure;

a first set of wires extending in a first direction through the enclosure;

a first plurality of switches, wherein each switch of the first plurality of switches is in electrical communication with at least one wire of the first set of wires and is configured to uniquely control said at least one wire of the first set of wires;

a second set of wires extending in a second direction through the enclosure, wherein each wire of the first set of wires and each wire of the second set of wires intersect to form a plurality of nodes; and a second plurality of switches, wherein each switch of the second plurality of switches is in electrical communication with at least one wire of the second set of wires and is configured to uniquely control said at least one wire of the second set of wires and wherein each of the plurality of electron guns is in electrical communication with one of the plurality of nodes such that each of the plurality of electron guns is configured to activate or deactivate based on a state of one of the plurality of nodes.

14. The X-ray source of claim 13, wherein each wire of the first set of wires intersects each wire of the second set of wires perpendicularly.

15. The X-ray source of claim 13, wherein the state of one of the plurality of nodes comprises at least one of on or off.

16. The X-ray source of claim 13, wherein the state of one of the plurality of nodes consists of on or off.

17. The X-ray source of claim 16, wherein, when the state of one of the plurality of nodes is on, one of the plurality of electron guns uniquely modulated by said one of the plurality of nodes is activated.

18. The X-ray source of claim 16, wherein, when the state of one of the plurality of nodes is off, one of the plurality of electron guns uniquely modulated by said one of the plurality of nodes is deactivated.

19. The X-ray source of claim 13, further comprising a plurality of feed throughs in the enclosure, wherein each of the plurality of feed throughs is configured to receive and pass into the enclosure one or more of the first set of wires or one or more of the second set of wires.

20. The X-ray source of claim 13, wherein each of the first plurality of switches and the second plurality of switches are positioned outside the enclosure.

21. The X-ray source of claim 13, wherein the state of one of the plurality of nodes is modulated by closing a switch of the first plurality switches in electrical communication with a first wire of the first set of wires and closing a switch of the second plurality of switches in electrical communication with a second wire of the second set of wires, wherein the first wire of the first set of wires and the second wire of the second set of wires together define the one of the plurality of nodes.

22. The X-ray source of claim 13, wherein the state of one of the plurality of nodes is modulated by opening a switch of the first plurality switches in electrical communication with a first wire of the first set of wires and opening a switch of the second plurality of switches in electrical communication with a second wire of the second set of wires, wherein the first wire of the first set of wires and the second wire of the second set of wires together define the one of the plurality of nodes.

23. The X-ray source of claim 13, wherein each of the plurality of electron guns is coupled to one or more AND gates, wherein each of the one or more AND gates comprises a first diode, a second diode and a resistor, and wherein each of the one or more AND gates is positioned inside the enclosure.

24. The X-ray source of claim 13, wherein a total number of the first set of wires is between 2 and 200 and a total number of the second set of wires is between 2 and 200.

25. The X-ray source of claim 24, wherein a total number of the plurality of nodes is between 4 and 4000 and a total number of the plurality of electron guns is equal to the total number of the plurality of nodes.

26. The X-ray source of claim 13, wherein the enclosure has an internal pressure level below atmospheric pressure.

27. The X-ray source of claim 13, wherein the enclosure has an internal pressure level below 1 atm.

28. An X-ray source comprising:

a vacuum housing;

a plurality of electron guns;

a plurality of modules, wherein each of the plurality of modules comprises one or more of the plurality of electron guns and wherein the plurality of modules are placed end-to-end to form a continuous locus of the plurality of electron guns within the vacuum housing;

a first plurality of address lines extending through the vacuum housing;

a second plurality of address lines extending through the vacuum housing, wherein the first plurality of address lines and the second plurality of address lines intersect at a plurality of nodes, wherein each of the plurality of electron guns is in electrical communication with one of the plurality of nodes such that a state of each of the plurality of electron guns is uniquely controlled by one of the first plurality of address lines and one of the second plurality of address lines;

a first multi-pin vacuum feed-through containing the first plurality of address lines; and a second multi-pin vacuum feed-through containing the second plurality of address lines.

29. The X-ray source of claim 28, wherein the state of each of the plurality of electron guns comprises on or off.

30. The X-ray source of claim 28, wherein the first plurality of address lines comprise a 'm' number of address lines, the second plurality of address lines comprise a 'n' number of address lines, the plurality of nodes comprise 'n×m' nodes and the plurality of electron guns comprise 'n×m' electron guns.

31. The X-ray source of claim 28, wherein m=24 and n=32.

32. The X-ray source of claim 28, wherein the first multi-pin vacuum feed-through contains a 'm' number of address lines and the second multi-pin vacuum feed-through contains a 'n' number of address lines such that 'n+m' number of feed-throughs penetrate a wall of the vacuum housing.

33. The X-ray source of claim 32, wherein m=24 and n=32.

34. The X-ray source of claim 28, wherein each of the plurality of modules has associated common grid support electrodes.

35. The X-ray source of claim 28, wherein each of the first plurality of address lines is coupled to one of a first plurality of switches and each of the second plurality of address lines is coupled to one of a second plurality of switches and wherein the first plurality of switches and the second plurality of switches are positioned outside the vacuum housing.

36. The X-ray source of claim 35, wherein an electron gun of the plurality of electron guns is uniquely activated by closing one of the first plurality of switches and one of the second plurality of switches respectively coupled to one of the first plurality of address lines and one of the second plurality of address lines associated with said electron gun.

37. The X-ray source of claim 28, wherein each of the plurality of electron guns is connected to one of a plurality of AND gates, wherein each of the plurality of AND gates are positioned within the vacuum housing, and wherein each of the plurality of AND gates is controlled by modulating a state of one of the first plurality of address lines and one of the second plurality of address lines.

38. The X-ray source of claim 37, wherein each of the plurality of AND gates comprises a first diode, a second diode and a resistor.

39. The X-ray source of claim 28, wherein a total number of the first plurality of address lines is between 2 and 200 and a total number of the second plurality of address lines is between 2 and 200.

40. The X-ray source of claim 28, wherein a total number of the plurality of nodes is between 4 and 4000 and a total number of the plurality of electron guns is equal to the total number of the plurality of nodes.

* * * * *